United States Patent [19]

Suekane et al.

[11] 4,188,981

[45] Feb. 19, 1980

[54] WEFT YARN SENSOR

[75] Inventors: Junnosuke Suekane, Musashi-murayama; Shuichi Kojima, Tokyo, both of Japan

[73] Assignee: Nissan Motor Company, Limited, Japan

[21] Appl. No.: 806,299

[22] Filed: Jun. 14, 1977

[30] Foreign Application Priority Data

Jun. 17, 1976 [JP] Japan ..... 51/70384

[51] Int. Cl.[2] ..... G01N 21/30; D03D 47/36

[52] U.S. Cl. ..... 139/370.2; 250/561; 250/571

[58] Field of Search ..... 139/336, 370.1, 370.2, 139/371; 250/559, 560, 561, 562, 227, 571

[56] References Cited

U.S. PATENT DOCUMENTS

| | | | |
|---|---|---|---|
| 3,489,910 | 1/1970 | Bohme et al. | 139/370.2 |
| 3,853,408 | 12/1974 | Kaalverink | 139/370.2 |
| 3,901,607 | 8/1975 | Kingsland | 250/261 |
| 3,996,476 | 12/1976 | Lazzara | 250/227 |

FOREIGN PATENT DOCUMENTS

| | | | |
|---|---|---|---|
| 2105559 | 8/1972 | Fed. Rep. of Germany | 139/370.2 |

*Primary Examiner*—Henry Jaudon

*Attorney, Agent, or Firm*—Robert E. Burns; Emmanuel J. Lobato; Bruce L. Adams

[57] ABSTRACT

A reflector is provided which produces from an incident light projected from one of two portions confronting each other at the gap of the sensor body to the other portion a reflected light offset with respect to the incident light in a direction lateral to the longitudinal direction of the weft yarn passed through the gap.

21 Claims, 8 Drawing Figures

WEFT YARN SENSOR

BACKGROUND OF THE INVENTION

1. Field of the Invention

The present invention relates generally to a weft yarn sensor for a weaving loom which senses the proper picking or insertion of the weft yarn into a predetermined position during the operation of the weaving loom and particularly to a weft yarn sensor for use in a fluid jet shuttleless weaving loom in which a weft yarn is inserted via a jet flow of fluid such as air which entrains the weft yarn and is guided or passed into the predetermined position through apertures formed in guiding members of an air guiding comb for preventing the diffusion of the fluid flow and a reduction in or a loss of the impetus of the fluid flow.

2. Description of the Prior Art

As is well known in the art, a conventional weft yarn sensor of this type includes a sensor body 10 as shown in FIG. 1 of the accompanying drawings which is located on a side of the air guiding comb near the weft yarn catching means and is swingably supported together with the air guiding comb and the reed. The sensor body 10 has two arms 11 and 12 defining an aperture 13 therebetween and formed so as to define a gap 14 between the ends thereof. The weft yarn 15 is passed through the apertures of the guiding members, and subsequently passed through the aperture 13 of the sensor body 10, then passed through gaps formed in the guiding members and the gap 14 of the sensor body 10 outside the apertures of the guiding members and the aperture 13 in the midst of the movement of the reed into its beat-up position. The arm 11 is provided with light projecting means 16 formed of light conductive means e.g. optical fibers which transmits light from a light source to the end of the arm 11 and projects the light to the end of the arm 12. The arm 12 is provided with light receiving means 17 such as, for example, photoelectric cell which receives the light projected from the light projecting means 16 to the end of the arm 12. The light projecting and receiving means 16 and 17 both are in the form of a circle at the ends of the arms 11 and 12.

When the weft yarn 15 is passed through the gap 14 outside the aperture 13, it intercepts the light projected from the light conductive means 16 to vary the quantity of light received by the light receiving means 17. This causes a change in the output of a light receiving device such as phototransistor connected to the photoelectric cell to sense that the weft yarn 15 has been properly inserted into the predetermined position. However, in the conventional weft yarn sensor, since only one beam is intercepted by the weft yarn 15 passed through the gap 14, a change in the quantity of light intercepted by the weft yarn 15 is extremely small and the time when the weft yarn 15 intercepts the beam is several milliseconds and accordingly fairly short. Thus, a change in the output of the light receiving device can not be sufficiently sensed by a sensing circuit and accordingly the conventional weft yarn sensor has been unable to surely and easily sense whether a weft yarn has been satisfactorily inserted into the predetermined position or not during loom operation.

Furthermore, when a fly fluff is sticked to the light projecting and/or receiving means 16 and/or 17 at the ends of the arms 11 and 12, since the fly fluff is in the form of a ball or a disk, it intercepts the light projected to the light receiving means 17 so that the conventional weft yarn sensor has malfunctioned as if the weft yarn has been properly inserted even through the weft yarn has in fact not been properly inserted.

SUMMARY OF THE INVENTION

It is, therefore, an object of the invention to provide an improved weft yarn sensor in which a weft yarn passed through the gap of the sensor body intercepts successively at least two beams with a time lag and overlap for greatly increasing the time during which the weft yarn intercepts light incident on light receiving means so that a change in the output of a light receiving device is surely and easily sensed.

It is a further object of the invention to provide an improved weft yarn sensor which can surely sense whether a weft yarn has been properly inserted or not without being influenced by attaching of a fly fluff to light projecting and/or receiving means.

These object are accomplished by providing reflector means which produces from a beam projected from the light projecting means a reflected beam incident on the light receiving means, and by making the form of each of the ends of the light projecting and receiving means elongate in the longitudinal direction of the weft yarn passed through the gaps.

BRIEF DESCRIPTION OF THE DRAWINGS

These and other features and advantages of the invention will become more apparent from the following detailed description taken in connection with the accompanying drawings in which.

DESCRIPTION OF THE SPECIFIC EMBODIMENTS

Figure 2:
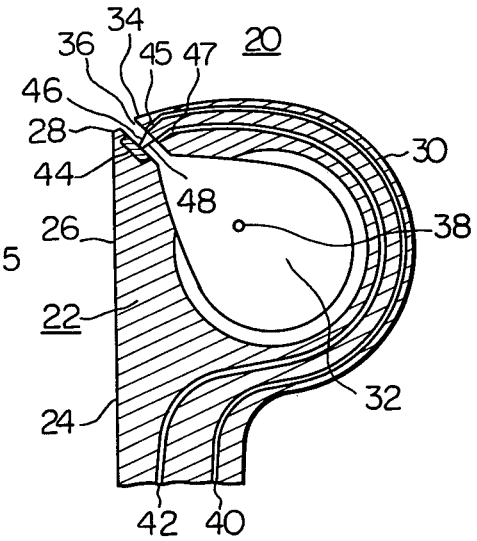
FIG. 2 is a cross sectional schematic view of a first preferred embodiment of a weft yarn sensor according to the invention.

Referring to FIG. 2 of the drawings, there is shown a part of a weft yarn sensor according to the invention. The weft yarn sensor, generally designated by the reference numeral 20, comprises a sensor body 22 having a form about similar to that of each of the guiding members of the guiding comb as mentioned hereinbefore. The sensor body 22 comprises a trunk portion 24, an upright arm portion 26 extending from the trunk portion 24 and having a free end portion 28, and a crescent arm portion 30 laterally branching off from the trunk portion 24. The crescent portion 30 is curved toward the free end 28 of the upright portion 26 so that an aperture 32 is formed between the upright and crescent portions 26 and 30. The crescent portion 30 has a free end portion 34 confronting and spaced from the free end 28 of the upright portion 26 a suitable distance so that a clearance 36 is formed between the free ends 28 and 34. The aperture 32 forms part of a weft yarn guiding passage through which a weft yarn 38 is passed when it is inserted into a shed of warp yarns (not shown). The gap 36 provides communication between the aperture 32 and the outside thereof so that the inserted weft yarn 38 is allowed to pass from the aperture 32 to the outside thereof. The illustration of a lower portion of the trunk portion 24 is omitted for purpose of brevity. The lower portion of the trunk portion 24 is fixedly supported in a support beam (not shown) together with the guiding members of the guiding comb and the reed so that the reed is angularly moved into and away from its beat-up position together with the guiding comb and the sensor body 22.

The weft yarn sensor 20 also comprises first light transmitting or conductive means 40 extending from the trunk portion 24 to the free end 34 of the crescent portion 30, a second light transmitting or conductive means 42 extending from the free end 34 of the crescent portion 30 to the trunk portion 24 and spaced from the first light conductive means 42, and a reflector 44 securely received in the free end 28 of the upright portion 26 and confronting the light conductive means 40 and 42. Each of the light conductive means 40 and 42 comprises a light conductive fiber such as, for example, optical fiber. The light conductive means 40 forms a light projecting or emitting portion which transmits light from a light source (not shown) such as, for example, light emission diode to an upper end 45 of the light conductive means 40 and projects the light from the end 45 to the reflector 44. The reflector 44 is formed and oriented in such a manner as to reflect the incident light 46, projected from the light conductive means 40, to an upper end 47 of the light conductive means 42. The light conductive means 42 forms a light receiving portion which transmits the reflected light 48 from the upper end 47 to a light receiving device (not shown) such as, for example, phototransistor. It is necessary to arrange the light conductive means 40 and 42 out of alignment with each other at the end portion 34 in the longitudinal direction of the weft yarn 38 passed through the gap 36 or to arrange the light conductive means 42 at the end 34 offset from a line which passes through the light conductive means 40 and which is parallel with the center line (not shown) of the aperture 32 so that the reflected and incident lights 46 and 48 are successively intercepted by the weft yarn with a time lag and overlap. The light conductive means 40 and 42 are received respectively in bores or grooves formed in the sensor body 22. The light projecting and receiving means 40 and 42 each extend into the lower portion of the trunk portion 24 and are connected with or associated with the light source and the light receiving device, respectively, which both are fixedly received in the support beam. The light receiving device is connected to a sensing circuit (not shown) to feed thereto an output signal representative of the quantity of light transmitted by the light receiving means 42.

Figure 3:
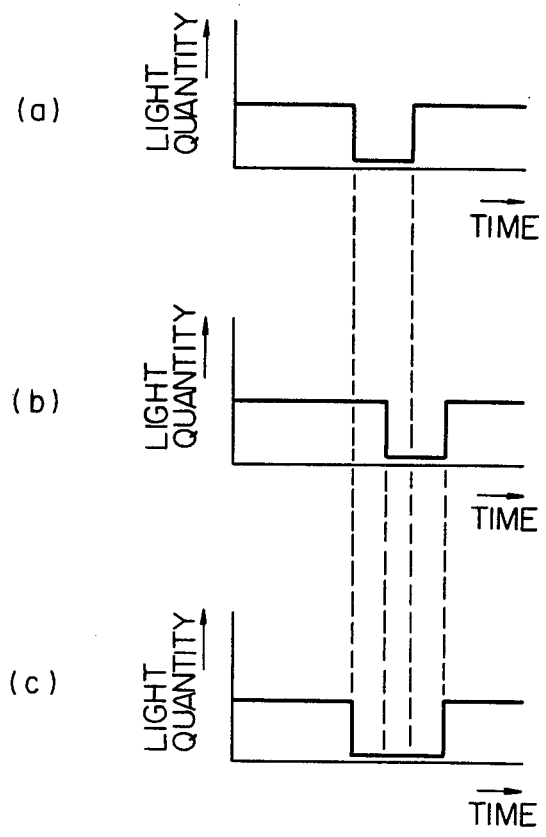
FIG. 3 is a graphic representation of the relationship between the time and the changes in the quantities of the incident and reflected lights and the light incident on the light receiving device in the weft yarn sensor shown in FIG. 2.

When the inserted weft yarn 38 is passed through the aperture 32 and then passed through the gap 36 outside the aperture 32 in the midst of movement of the sensor body 22 together with the reed and the guiding comb (both not shown) into beat-up position, it intercepts two beams, that is, the incident and reflected beams 46 and 48 to reduce the light quantities incident on the reflector 44 and the light conductive means 42 as shown respectively in FIGS. 3(*a*) and (*b*) of the drawings. As shown in FIGS. 3(*a*) and (*b*), since a lag is existent between the times when the weft yarn 38 intercepts the incident and reflected beams 46 and 48, respectively, the time when the weft yarn reduces 38 the quantity of light transmitted to the light receiving device by the light conductive means 42 is greatly increased as shown in FIG. 3(*c*) of the drawings as compared with the time when a weft yarn reduces the quantity of light transmitted to a light receiving device in the case of the conventional weft yarn sensor shown in FIG. 1 in which the weft yarn intercepts only one beam such as either of the incident and reflected beams as shown in either of FIGS. 3(*a*) and (*b*). In this manner, since the time when the light fed to the light receiving device is intercepted by the weft yarn is fairly long as compared with the case of the conventional weft yarn sensor of FIG. 1, variations in the quantity of light transmitted to the light receiving device can be surely sensed by the sensing circuit.

Although the weft yarn sensor 20 has been described such that the light conductive means 40 and 42 are received in the trunk and crescent portions 24 and 30 and the reflector 44 is located in the free end 28 of the upright portion 26, the weft yarn sensor 20 may be modified such that the light conductive means 40 and 42 are received in the trunk and upright portions 24 and 26 and the reflector 44 is located in the free end 34 of the crescent portion 30. The light conductive means 40 and 42 may be fixedly mounted on an exterior surface of the sensor body 22 in lieu of receiving the means 40 and 42 in the sensor body 22.

Figure 4:
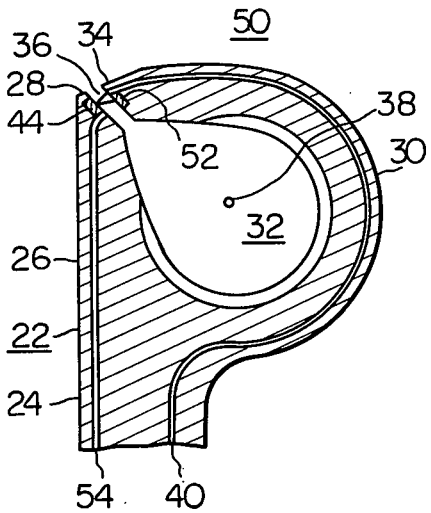
FIG. 4 is a cross sectional schematic view of a second preferred embodiment of a weft yarn sensor according to the invention.

Referring to FIG. 4 of the drawings, there is shown a part of a weft yarn sensor characterized in that the number of beams intercepted by the weft yarn 38 is increased to three (3). In FIG. 4, like component elements are designated by the same reference numerals as those used in FIG. 2. The weft yarn sensor, generally designated by the reference numeral 50, comprises the first light conductive means 40, the reflector 44, a reflector 52 fixedly secured to the free end 34 of the crescent portion 30 and confronting the reflector 44, and second light conductive means 54 extending from the free end 28 of the upright portion 26 to the trunk portion 24 and confronting the reflector 52. The second light conductive means 54 is received in a bore or groove formed in the sensor body 22 and is connected to or associated with the light receiving device as mentioned hereinbefore. The reflector 44 reflects therefrom to the reflector 52 the incident light projected from the first light conductive means 40. The reflector 52 reflects therefrom to the second light conductive means 54 the incident light reflected from the reflector 44.

It is necessary to arrange the light conductive means 40 and a point of the reflector 52 which receives the reflected light from the reflector 44 out of alignment with each other at the end portion 34 in the longitudinal direction of the weft yarn 38 passed through the gap 36 outside the aperture 32 or to arrange the reflector 52 at the end portion 34 offset from a line which passes through the light conductive means 40 and which is parallel with the center line of the aperture 32 so that the reflected light and the incident light are successively intercepted by the weft yarn with a time lag and overlap. It is also necessary that the light conductive means 54 is located at the end portion 28 offset from a line which passes through the reflector 44 and which is parallel with the center line of the aperture 32 so that the weft yarn 38 intercepts successively the reflected light from the reflectors 52 and 44 respectively with a time lag.

In the weft yarn sensor 50 thus constructed and arranged, when the weft yarn 38 is passed through the gap 36 outside the aperture 32 prior to beat-up operation of the reed, it intercepts successively three beams, that is, the beam incident on the reflector 44, and the beams reflected respectively from the reflectors 44 and 52. Accordingly, since the weft yarn 38 intercepts the light transmitted from the light conductive means 40 to the light conductive means 54, for a time longer than the time when the weft yarn 38 intercepts the light transmitted from the means 40 to the means 42 in the case of the weft yarn sensor 20 shown in FIG. 2, the sensing circuit can more surely sense variations in the quantity of light transmitted to the light receiving device and variations in the output of the light receiving device as compared with the case of the weft yarn sensor 20 of FIG. 2.

Although the weft yarn sensor 50 has been described such that the light projected from the first light conductive means 40 is increased to two reflected beams by the provision of the two reflectors 44 and 52, the light projected from the means 40 can be increased to three or more reflected beams by the provision of three or more reflectors.

Figure 5:
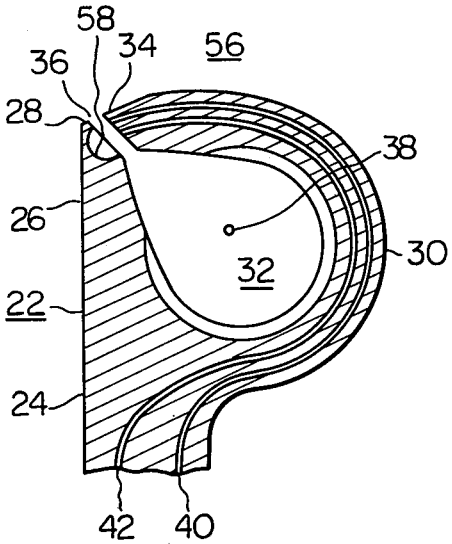
FIG. 5 is a cross sectional schematic view of a third preferred embodiment of a weft yarn sensor according to the invention.
Figure 6:
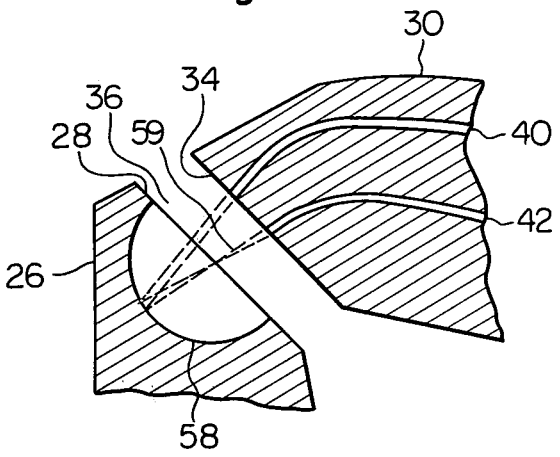
FIG. 6 is an enlarged cross sectional schematic view of a part of the weft yarn sensor shown in FIG. 5.

Referring to FIGS. 5 and 6 of the drawings, there is shown a part of a weft yarn sensor characterized in that it is constructed and arranged in such a manner that the weft yarn 38 passed through the gap 36 intercepts a reflected light focussed by a reflector. In FIGS. 5 and 6, like component elements are designated by the same reference numerals as those used in FIG. 2. The weft yarn sensor, generally designated by the reference numeral 56, comprises the first and second light conductive means 40 and 42, and a reflector 58 fixedly received in the free end 28 of the upright portion 26 and confronting the light conductive means 40 and 42. The reflector 58 comprises a concave mirror having a segmental spherical internal surface or a segmental cylindrical internal surface in this embodiment. The reflector 58 reflects the light, projected from the light conductive means 40, to the light conductive means 42 and is formed and arranged in such a manner that the reflected light is focussed at a predetermined position in the gap 36 as shown at the point 59 in FIG. 5 which position lies in a plane in which the weft yarn 38 is passed through the gap 36. The light conductive means 40 and the reflector 58 are constructed and arranged relative to each other in such a manner that the incident and reflected lights are offset with respect to each other in a direction perpendicular to the longitudinal direction of the weft yarn 38 passed through the gap 36.

Figure 1:
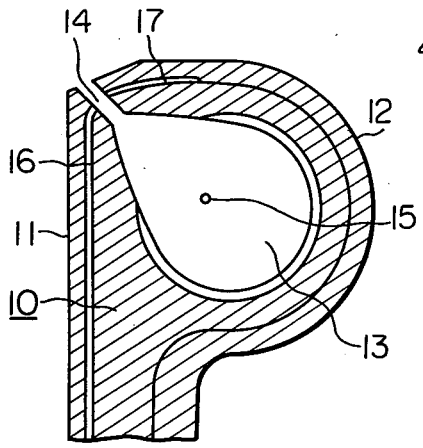
Prior Art Fig. 1
FIG. 1 is a cross sectional schematic view of a conventional weft yarn sensor as per the introduction of the present specification.

In the weft yarn sensor 56 thus described, when the weft yarn 38 is passed through the gap 36 outside the aperture 32 and intercepts the light reflected by the reflector 58 and focussed at the predetermined position prior to intercepting of the incident light projected from the light conductive means 40 to the reflector 58, since the weft yarn 38 increases a variation in the quantity of light transmitted to the light receiving device and causes a variation in the output of the light receiving device as compared with the case in which a reflected light not focussed is intercepted by a weft yarn passed through a gap of a sensor body as in the weft yarn sensor 20 of FIG. 2 and the conventional weft yarn sensor of FIG. 1, the variation in the output of the light receiving device can be more surely sensed by the sensing circuit.

Figure 7:
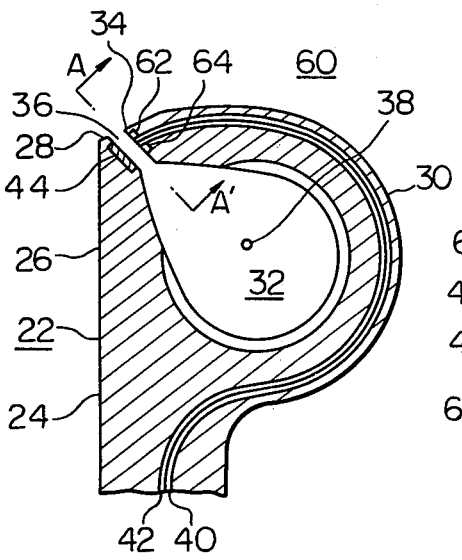
FIG. 7 is a cross sectional schematic view of a fourth preferred embodiment of a weft yarn sensor according to the invention.
Figure 8:
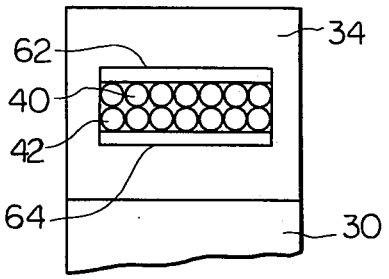
FIG. 8 is a schematic end view taken substantially along a line A–A′ of FIG. 7.

Referring to FIGS. 7 and 8 of the drawings, there is shown a part of a weft yarn sensor characterized in that each of the incident and reflected lights has a form which is fairly elongate in the longitudinal direction of the weft yarn 38 passed through the gap 36 or inserted through the aperture 32. In FIGS. 7 and 8, like component elements are designated by the same reference numerals as those used in FIG. 2. The weft yarn sensor, generally designated by the reference numeral 60, comprises the first and second light conductive means 40 and 42, and the reflector 44, similarly to the weft yarn sensor 20 of FIG. 2. In this embodiment, each of the light conductive means 40 and 42 comprises a plurality of light conductive elements which, for example, comprises a plurality of light conductive fibers. The light conductive fibers are arranged in alignment with each other at the free end 34 of the crescent portion 30 in the longitudinal direction of the weft yarn 38 passed through the gap 36 by suitable fastening means, as shown in FIG. 8. The fastening means comprises two thin boards or members 62 and 64 of rectangle forms fixedly secured to the free end 34 of the crescent portion 30 in this embodiment and the two rows of the light conductive fibers 40 and 42 are interposed between the thin boards 62 and 64 as shown in FIG. 8. The reflector 44 reflects the incident light, projected from the light conductive fibers 40, to the light conductive fibers 42.

In the weft yarn sensor 60 thus described, when the weft yarn 38 passed through the gap 36 outside the aperture 32 intercepts the reflected light from the reflector 44 and the incident light from the light conductive fibers 40, the quantity of light intercepted by the weft yarn 38 is fairly increased as compared with the case in which, for example, the weft yarn intercepts light projected from the end of the first light conductive means which end has the form of a circle as the conventional weft yarn sensor of FIG. 1. Accordingly, since, when the weft yarn 38 intercepts the reflected and incident lights from and to the reflector 44, respectively, a change in the quantity of light transmitted to the light receiving device is fairly increased as compared with the conventional weft yarn sensor, a change in the output of the light receiving device can be surely sensed by the sensing circuit. Also, since each of the light conductive means 40 and 42 has a form elongate in the longitudinal direction of the inserted weft yarn, the whole face of each of the light conductive means 40 and 42 is prevented from being covered by a fly fluff which is usually in the form of a ball or a disk. As a result, whether a weft yarn has been properly inserted into a predetermined position or not is surely sensed without being influenced by attaching of the fly fluff to the light conductive means 40 and/or 42.

When each of the light conductive fibers 40 and 42 has a diameter which is about equal to or smaller than that of the weft yarn 38, since a change or a decrease in the quantity of light transmitted to the light receiving device when the light is intercepted by the weft yarn 38 is further increased, a change in the output of the light receiving device can be more surely sensed by the sensing circuit. Also, similar result is obtained by making the distance between the thin boards 62 and 64 or the diameter of each of the light conductive fibers 40 and 42 about equal to or smaller than the radius of the weft yarn 38.

Each of the light conductive means 40 and 54 can be formed of a plurality of light conductive members such as a plurality of optical fibers which have respectively ends located at the corresponding end portion 28 or 34 and are arranged at the ends in alignment with each other in the longitudinal direction of the weft yarn 38. It is desirable that each of the optical fibers has a diameter which is not larger than that of the weft yarn 38.

Although the weft yarn sensor 60 has been described such that each of the light conductive means 40 and 42 comprises a plurality of light conductive elements arranged in alignment with each other at the end portion 34 in the longitudinal direction of the weft yarn 38 inserted, it is also possible to form only one of the light conductive means 40 and 42 of a plurality of light conductive elements arranged in alignment with each other at the end portion 34 similarly as mentioned above.

Although each of the weft yarn sensors 20, 50, 56 and 60 is constructed such that the light conductive means 40 is located outer than the light conductive means 42 in the crescent portion 30 or in the upright and crescent portions 26 and 30, the each weft yarn sensor can be modified such that the light conductive means 40 is located inner than the light conductive means 42.

Each of a light source and a light receiving device can be directly located at one of portions defining the gap in lieu of the provision of the light conductive means 40 and 42 or 54.

It will be thus appreciated that the invention provides an improved weft yarn sensor in which the number of beam intercepted with a time lag by a weft yarn passing through the gap of the sensor body outside the aperture thereof is increased to at least two (2) and the time when the light fed to the light receiving device is intercepted by the weft yarn is increased to two times or more by the provision of reflector means producing at least one reflected beam so that changes in the quantity of light fed to the light receiving device and in the output of the light receiving device can be surely sensed and accordingly the performance of sensing the weft yarn is strikingly increased.

It will be also appreciated that the invention provides an improved weft yarn sensor in which a concave mirror employed as a reflector produces a reflected light focussed at a predetermined position in the gap so that when the reflected light is intercepted by the weft yarn even if the diameter thereof is relatively fine, a change in the quantity of light fed to the light receiving device is more increased and a change in the output of the light receiving device is more surely sensed.

It will be further appreciated that the invention provides an improved weft yarn sensor in which at least one of light projecting and receiving sections comprises a plurality of light conductive elements arranged in alignment with each other at one of portions of the sensor body defining the gap so that when the weft yarn intercepts the incident and/or reflected lights, a change in the light quantity is more increased and whether the weft yarn has been properly inserted or not can be surely sensed without being influenced by attaching of a fly fluff to the light projecting and/or receiving section.

What is claimed is:

1. A weft yarn sensor in combination with a weaving loom, comprising a sensor body formed with an aperture through which an inserted weft yarn is passed during insertion, said sensor body having first and second portions confronting each other and defining therebetween a gap providing communication between said aperture and the outside thereof for allowing the weft yarn to be passed from said aperture to the outside thereof prior to beat-up, light projecting means located at said first portion for projecting light to said second portion, light reflecting means located at said second portion for producing a reflected light from the light projected from said light projecting means, and light receiving means located at said first portion for receiving said reflected light, said light receiving means being offset from a line which passes through said light projecting means and which is parallel with the center line of said aperture, at least one of said light projecting means and said light receiving means having a length which is elongate in the longitudinal direction of the weft yarn passed from said aperture to the outside thereof through said gap and a width which is fairly short in the direction of the diameter of the weft yarn passed through said gap.

2. A weft yarn sensor as claimed in claim 1, in which said light reflecting means comprises a concave mirror for producing from the light projected from said light projecting means a reflected light focussed at a predetermined position in said gap.

3. A weft yarn sensor as claimed in claim 1, in which said width is not larger than a diameter of the weft yarn passed through said gap.

4. A weft yarn sensor in combination with a weaving loom, comprising a sensor body formed with an aperture through which an inserted weft yarn is passed during insertion, said sensor body having first and second portions confronting each other and defining therebetween a gap opening from said aperture to the outside thereof for allowing the weft yarn located in said aperture to be passed therefrom to the outside thereof prior to beat-up, light projecting means located at said first portion for projecting light to said second portion, first light reflecting means located at said second portion for receiving the light projected from said light projecting means for producing a first reflected light, second light reflecting means located at said first portion for receiving said first reflected light for producing a second reflected light, said second light reflecting means being offset from a line which passes through said light projecting means and which is parallel with the center line of said aperture, and light receiving means located at said second portion for receiving said second reflected light, said light receiving means being offset from a line which passes through said first light reflecting means and which is parallel with the center line of said aperture, at least one of said light projecting means and said light receiving means having a length which is elongate in the longitudinal direction of the weft yarn passed from said aperture to the outside thereof through said gap and a width which is fairly short in the direction of the diameter of the weft yarn passed through said gap.

5. A weft yarn sensor as claimed in claim 4, in which said width is not larger than a diameter of the weft yarn passed through said gap.

6. A weft yarn sensor for a weaving loom, comprising a sensor body having first and second arm portions defining therebetween an aperture through which an inserted weft yarn is passed during insertion, said first and second arm portions having respectively first and second opposite end portions which confront each other and define therebetween a gap opening from said aperture to the outside thereof for allowing the weft yarn located in said aperture to be passed therefrom to the outside thereof prior to beat-up, a plurality of light conducting members supported by said first arm portion for conducting light to said first end portion and which have respectively ends located at said first end portion for projecting to said second end portion the light conducted to said first end portion, said plurality of light conducting members being arranged at said ends in alignment with each other in the longitudinal direction of the weft yarn passed through said gap, light reflecting means located at said second end portion for receiving the light projected from said plurality of light conducting members for producing a reflected light, and light receiving means located at said first end portion for receiving said reflected light, said light receiving means being offset from a line which passes through said ends of said plurality of light conducting members and which is parallel with the center line of said aperture.

7. A weft yarn sensor as claimed in claim 6, in which said light receiving means comprises a second plurality of light conducting members supported by said first arm portion for conducting said reflected light and which have respectively ends located at said first end portion for receiving said reflected light, said second plurality of light conducting members being arranged at said ends in alignment with each other in said longitudinal direction of the weft yarn passed through said gap.

8. A weft yarn sensor as claimed in claim 7, in which each of said second plurality of light conducting members is an optical fiber.

9. A weft yarn sensor as claimed in claim 8, in which said optical fiber has a diameter which is not larger than that of the weft yarn passed through said gap.

10. A weft yarn sensor as claimed in claim 6, in which each of said plurality of light conducting members is an optical fiber.

11. A weft yarn sensor as claimed in claim 10, in which said optical fiber has a diameter which is not larger than that of the weft yarn passed through said gap.

12. A weft yarn sensor for a weaving loom, comprising a sensor body having first and second arm portions defining therebetween an aperture through which an inserted weft yarn is passed during insertion, said first and second arm portions having respectively first and second opposite end portions which confront each other and define therebetween a gap opening from said aperture to the outside thereof for allowing the weft yarn located in said aperture to be passed therefrom to the outside thereof prior to beat-up, a plurality of light conducting members supported by said first arm portion for conducting light to said first end portion and which have respectively ends located at said first end portion for projecting to said second end portion the light conducted to said first end portion, said plurality of light conducting members being arranged at said ends in alignment with each other in the longitudinal direction of the weft yarn passed through said gap, first light reflecting means located at said second end portion for receiving the light projected from said plurality of light conducting members for producing a first reflected light, second light reflecting means located at said first end portion for receiving said first reflected light for producing a second reflected light, said second light reflecting means being offset from a line which passes through said ends of said plurality of light conducting members and is parallel with the center line of said aperture, and light receiving means located at said second end portion for receiving said second reflected light, said light receiving means being offset from a line which passes through said first light reflecting means and is parallel with the center line of said aperture.

13. A weft yarn sensor as claimed in claim 12, in which said light receiving means comprises a second plurality of light conducting members which are supported by said second arm portion for conducting said second reflected light and which have respectively ends located at said second end portion for receiving said second reflected light, said second plurality of light conducting members being arranged at said ends in alignment with each other in said longitudinal direction of the weft yarn passed through said gap.

14. A weft yarn sensor as claimed in claim 13, in which each of said second plurality of light conducting members is an optical fiber.

15. A weft yarn sensor as claimed in claim 14, in which said optical fiber has a diameter which is not larger than that of the weft yarn passed through said gap.

16. A weft yarn sensor as claimed in claim 12, in which each of said plurality of light conducting members is an optical fiber.

17. A weft yarn sensor as claimed in claim 16, in which said optical fiber has a diameter which is not larger than that of the weft yarn passed through said gap.

18. A weft yarn sensor for a weaving loom, comprising a sensor body having first and second arm portions defining therebetween an aperture through which an inserted weft yarn is passed during insertion, said first and second arm portions having respectively first and second end portions which confront each other and define therebetween a gap opening from said aperture to the outside thereof for allowing the weft yarn located in said aperture to be passed therefrom to the outside thereof prior to beat-up, light projecting means located at said first end portion for projecting light to said second end portion, light reflecting means located at said second end portion for receiving the light projected from said light projecting means for producing a reflected light, and a plurality of optical fibers which are supported by said first arm portion for conducting said reflected light and which have respectively ends located at said first end portion for receiving said reflected light, said plurality of optical fibers being arranged at said ends in alignment with each other in the longitudinal direction of the weft yarn passed through said gap, said ends of said plurality of optical fibers being offset from a line which passes through said light projecting means and is parallel with the center line of said aperture.

19. A weft yarn sensor as claimed in claims 18, in which said optical fiber has a diameter which is not larger than that of the weft yarn passed through said gap.

20. A weft yarn sensor for a weaving loom, comprising a sensor body having first and second arm portions defining therebetween an aperture through which an inserted weft yarn is passed during insertion, said first and second end portions which confront each other and define therebetween a gap opening from said aperture to the outside thereof for allowing the weft yarn located in said aperture to be passed therefrom to the outside thereof prior to beat-up, light projecting means located at said first end portion for projecting light to said second end portion, first light reflecting means located at said second end portion for receiving the light projected from said light projecting means for producing a first reflected light, second light reflecting means located at said first end portion for receiving said first reflected light for producing a second reflected light, said second light reflecting means being offset from a line which passes through said light projecting means and is parallel with the center line of said aperture, and a plurality of optical fibers supported by said second arm portion for conducting said second reflected light and which have respectively ends located at said second end portion for receiving said second reflected light, said plurality of optical fibers being arranged at said ends in alignment with each other in the longitudinal direction of the weft yarn passed through said gap, said ends of said plurality of optical fibers being offset from a line which passes through said first light reflecting means and which is parallel with the center line of said aperture.

21. A weft yarn sensor as claimed in claim 20, in which said optical fiber has a diameter which is not larger than that of the weft yarn passed through said gap.

* * * * *